US005465644A

United States Patent [19]

Shimoda et al.

[11] Patent Number: 5,465,644

[45] Date of Patent: Nov. 14, 1995

[54] STAND STRUCTURE FOR A KEYED INSTRUMENT

[75] Inventors: Yoshiaki Shimoda; Masaji Kimura, both of Hamamatsu, Japan

[73] Assignee: Kabushiki Kaisha Kawai Gakki Seisakusho, Shizuoka, Japan

[21] Appl. No.: 250,334

[22] Filed: May 26, 1994

Related U.S. Application Data

[63] Continuation of Ser. No. 17,152, Feb. 12, 1993, abandoned.

[30] Foreign Application Priority Data

Mar. 31, 1992 [JP] Japan ..... 4-026541 U

[51] Int. Cl.[6] ..... G10D 13/02

[52] U.S. Cl. ..... 84/423 R; 84/177; 84/352; 84/190; 84/DIG. 17

[58] Field of Search ..... 84/423 R, 327, 84/453, 177, 352, 190, 290, DIG. 17

[56] References Cited

U.S. PATENT DOCUMENTS

| | | | |
|---|---|---|---|
| 2,505,805 | 5/1950 | Stein | 84/177 |
| 2,600,910 | 6/1952 | Nickel | 84/177 |
| 3,602,083 | 8/1971 | Iijima | 84/177 |
| 4,297,937 | 11/1981 | Mayerjak | 84/177 |

*Primary Examiner*—Thomas M. Dougherty
*Assistant Examiner*—Cassandra Spyrou
*Attorney, Agent, or Firm*—Evenson, McKeown, Edwards & Lenahan

[57] ABSTRACT

A stand structure for a keyed instrument having a main body with a keyboard at the front thereof, the stand structure including a first side plate and a second side plate, the first side plate and the second side plate being adapted for supporting at least a lower portion of the main body arranged between the first side plate and the second side plate; a back plate arranged between the first side and the second side plate for reinforcing the first side and the second side plate, the back plate being adapted to be arranged below the main body; a first single securing member adapted for interconnecting the main body, the back plate and the first side plate; a second single securing member adapted for interconnecting the main body, the back plate and the second side plate; and a pair of screw means, each of the pair of screw means being adapted for extending laterally through one of the first side plate and the second side plate and into the lower portion of the main body so as to secure the main body to the one of the first side and the second side plate.

2 Claims, 4 Drawing Sheets

STAND STRUCTURE FOR A KEYED INSTRUMENT

This application is a continuation of U.S. application Ser. No. 08/017,152 filed Feb. 12, 1993 now abandoned.

BACKGROUND OF THE INVENTION

1. Field of the Invention

The present invention relates to a stand structure for forming legs of a keyed instrument such as an electronic piano.

2. Description of Background Art

There is one stand structure of this type known in the prior art such as shown in FIG. 6 of the accompanying drawings. This stand is formed by a pair of side plates 114 and 114 (one of which is shown) for supporting a main body 102 of a keyed instrument, and a back plate 115 arranged between the side plates 114 and 114 for reinforcing them. A base 116 is secured to the bottom end of each side plate 114 and a pedal board 118 is arranged between the bases 116 and 116. The main body 102 is screwed onto the top ends of the side plates 114 through main body securing fittings (brackets) 151 such as L-shaped fittings. The back plate 115 is arranged below the main body 102 and secured on the side plates 114 therebetween by screws through back plate securing fittings (brackets) 152 such as L-shaped fittings separate from the main body securing fittings 151.

However since in the stand structure of the prior art, the main body 102 and the back plate 115 are separately mounted on each of the side plates 114, the substantial part of the strength of the stand is taken charge of by the back plate 115 and therefore there is a problem that the width of the back plate 115 must be enlarged in order to give the stand sufficient strength. In addition, since it is required both the fittings 151 for securing the main body 102 and the fittings 152 for securing the back plate 115, the number of the parts and accordingly the steps of assembly are increased.

SUMMARY OF THE INVENTION

It is therefore an object of the present invention to overcome the problems of the prior art mentioned above and to provide a stand structure of a keyed instrument which can get sufficient strength while reducing the number of the parts.

According to the present invention, the object is achieved by a stand structure of a keyed instrument having a pair of side plates to which a main body of the keyed instrument is secured wherein at least a lower portion of the main body is arranged between said side plates and said main body is directly secured to side plates.

The object of the present invention is also achieved by a stand structure of a keyed instrument having a pair of side plates to which a main body of the keyed instrument and a back plate arranged between said side plates for reinforcing them therein said main body, back plate and one of the side plates are interconnected through single securing member.

Since the main body of the keyed instrument is arranged between a pair of side plates and directly secured thereto, it is possible to eliminate the securing member and also to increase the contact area between the main body and the side plates, which enables the main body to take charge of apart of the lateral load. In addition, the fixation of the main body, back plate and the side plates through single securing member makes it possible to omit either one of the securing member for securing the main body and the side plates or the securing member for securing the side plates and the back plate.

DESCRIPTION OF THE PREFERRED EMBODIMENT

A preferred embodiment of the present invention will be hereinafter described with reference to the accompanying drawings.

Figure 1:
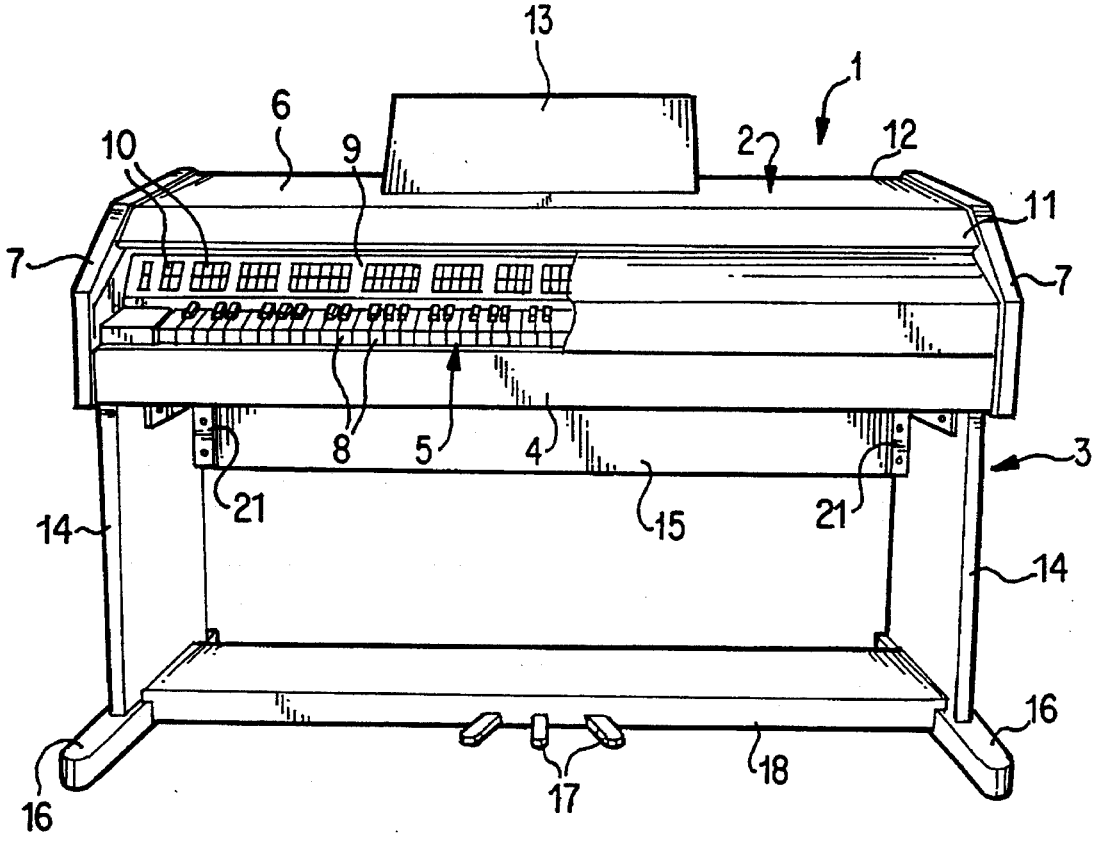
FIG. 1 is a perspective view showing an electronic piano to which the present invention is applied.

There is shown in FIG. 1 an external appearance of an electronic piano 1 into which a stand structure of the present invention is incorporated and which comprises a main body 2 of piano, and a stand 3 for supporting the main body 2. The main body 2 has a keyboard section 5 and a device section 6 arranged before and behind of a bottom plate 4 attache dot the stand 3 ("before" and "behind" used herein mean respectively "proximal" to and "distal" from a player), and also has a pair of arm members 7 and 7 arranged with sandwiching the keyboard section 5 and the device section 6 therebetween.

The keyboard section 5 has a keyboard 8 and a control panel 9 arranged behind the keyboard 8 in which many kinds of control switches 10 are arranged. The device section 6 has a top plate 11 and a rear plate 12. An acoustic device and the like (not shown) are contained in a space defined by the top, rear and bottom plates 11, 12 and 4. A music stand 13 is mounted on the top of the top plate 11.

The stand 3 comprises a pair of side plates 14 and 14 and a back plate 15 arranged between the back plates 14 and 14 for reinforcing them. A base 16 is secured on the bottom end of each side plate 14 and a pedal board 18 on which pedals 17 are mounted is arranged between the bases 16 and 16.

Figure 2:
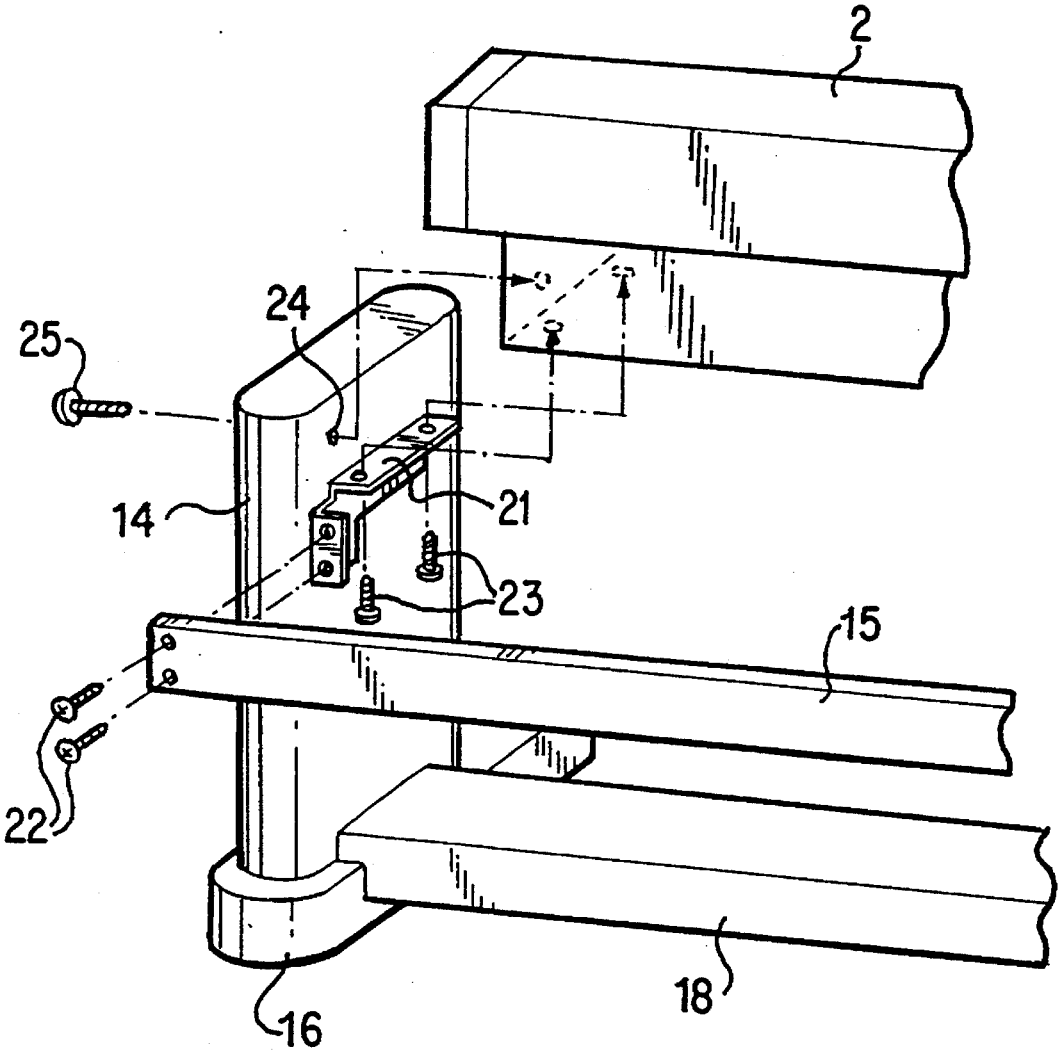
FIG. 2 is an exploded perspective view of the stand of electronic piano of FIG. 1 viewed from the back thereof.
Figure 3:
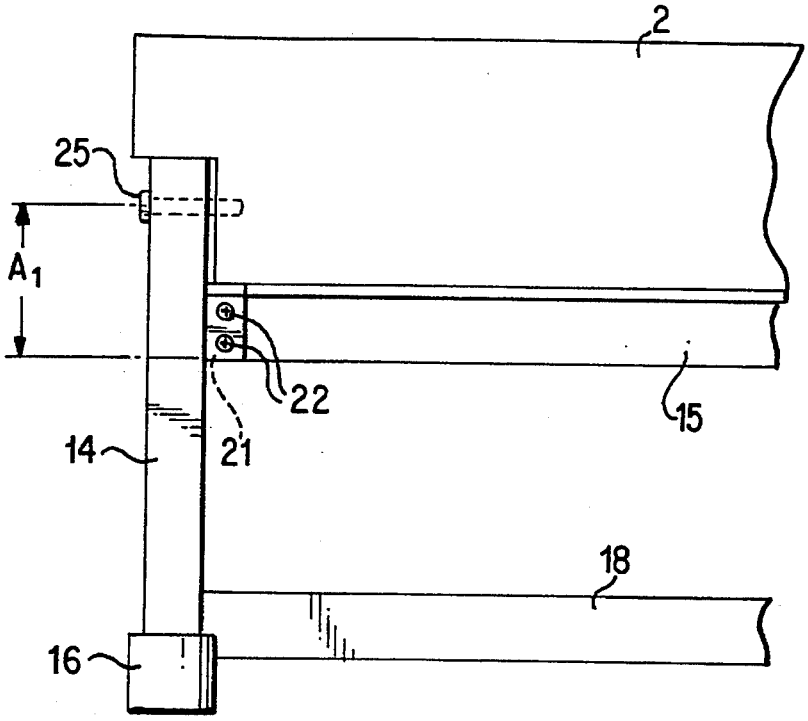
FIG. 3 is a rear view of the stand of electronic piano of FIG. 1 showing the assembled condition thereof.
Figure 4:
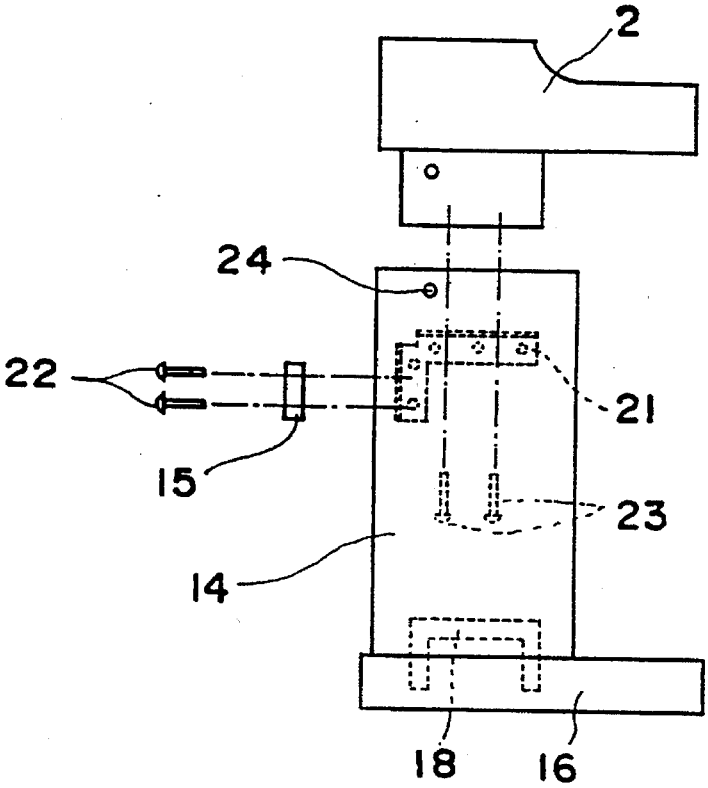
FIG. 4 is a side elevational view of the stand of electronic piano of FIG. 1 showing an assembling step thereof.
Figure 5:
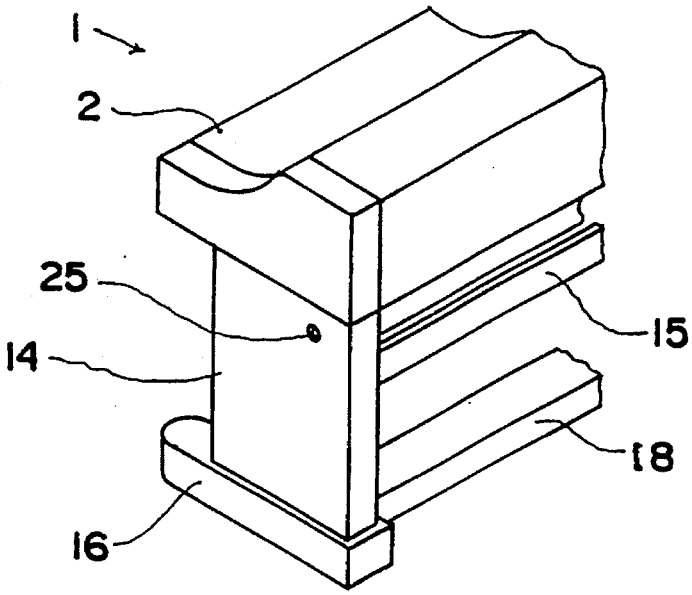
FIG. 5 is a perspective view of the stand of electronic piano of FIG. 1 showing the assembled condition thereof.

Then a structure of a stand will be explained with reference to FIG. 2 through FIG. 5. As shown in FIG. 2, in the stand 3 of one embodiment of the present invention, a generally L-shaped securing fitting (bracket) 21 is secured on the inside and upper portion of each side plate 14. The securing fitting 21 is formed by folding ½ width of each side of a substantially L-shaped steel plate. The main portion of the fitting 21, the folded long side portion and the short side portion form securing surfaces (contact surfaces) respectively for the side plate 14, the main body 2 of piano and the back plate 15. One end of the back plate 15 is secured to the vertically extending short side portion of the fitting 21 by screws 22 and the end face of the back plate 15 is adapted to abut against the inside surface of the side plate 14. On the other hand, one side end of the main body 2 is placed on the horizontally extending long side portion of the fitting 21 and secured thereto by screws 23. The main body portion of the securing fitting 21 is firmly secured to the side plate 14 by screws (FIG. 4). That is, the securing fitting 21 is formed with three securing surfaces perpendicular to each other by its main body portion, long side portion and short side portion, and the side plate 14, the main body 2 of piano and the back plate 15 are respectively secured thereto and thus increase the whole strength of the stand 3.

On the other hand, the main body 2 of piano has a projected lower portion having a width adapted to be fitted into a space between the side plates 14 and 14 (a part of the acoustic device and the like are contained in an inside space of the lower projected portion). Accordingly the whole height of the electronic piano of the present embodiment is reduced by a height corresponding to the projected portion as compared with that of the prior art. In addition, the end surfaces of the projected portion of the main body 2 of piano are abutted against the upper inside surfaces of the side plates 14 when the projected portion is arranged between the side plates 14 and is secured to the side plates 14 by screws 25 passed through screw apertures 24 formed in the side plates 14. That is, the main body 2, at the lower projected portion thereof, is directly secured to the side plates 14 and is also secured to the side plates 14 through the securing fitting 21. Since the main body 2 is secured to the side plates 14 along orthogonal two axes and with large contact area at the lower projected portion, it is possible to obtain a strongly secured condition.

Figure 6:
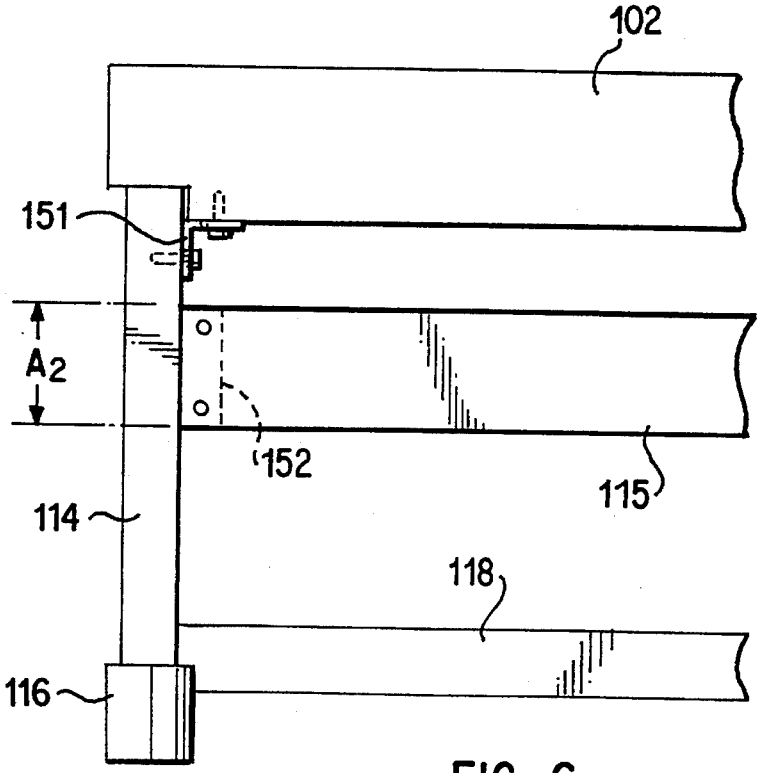
FIG. 6 PRIOR ART
FIG. 6 is a rear view similar to FIG. 3 showing the stand of electronic piano of the prior art.

According to the stand structure mentioned above, the main body 2 of piano is firmly secured to the back plate 15 through the securing fitting 21 and behaves together with the back plate 15 and therefore supports the lateral load of the stand 3 together with it. The lower projected portion of the main body 2 of piano may be served as the back plate 15. As the result of which, the length for supporting the side plate 14 is enlarged to a length "$A_1$" in FIG. 3 which corresponds to a distance from a position of the screw 25 to the bottom edge of the main body 2 plus the width of the back plate 15 as compared with the length "$A_2$" in FIG. 6 of the prior art which corresponds the width of the back plate 115, and therefore it is possible to reduce the width of the back plate 15 in case of the present invention in order to get the same stand strength as that of the prior art, which accordingly reduces the cost of the back plate 15. In addition, only one fitting is required for securing the main body 2 of piano and the back plate 15 at one side thereof, this reduces the number of the parts required in the prior art and therefore the cost thereof. The screw 25 also serves to prevent the rotation and turning over of the main body 2 of piano.

The present invention can be carried out in various other embodiments than the embodiment described above. Although the L-shaped fitting is used for securing the main body of piano and the back plate in the embodiment shown, it is, of course, possible to use fittings having other configurations and other suitable means. Instead of the provision of the projection of the main body 2 it is possible to extend the rear plate 12 downwardly to serve as the back plate 15.

According to the stand structure of keyed instrument of the present invention, it is possible to reduce the width of the back plate and the number of the parts, which therefore reduces the number of the steps of assembly and the manufacturing cost.

What is claimed is:

1. A stand structure for a keyed instrument having a main body with a keyboard at a front thereof, said structure comprising:

first and second side plates;

first and second single securing members respectively secured to inner surfaces of said first and second side plates;

a back plate arranged between said first and second side plates and secured to said first and second single securing members, respectively, for reinforcing said first and second side plates;

a pair of screw means, each of the screw means extending laterally through one of sad first and second side plates; and said first and second side plates being adapted for supporting the main body, by placing the main body on said first and second side plates, arranging at least a lower portion of the main body between said first and second side plates, connecting the main body to said first and second side plates through said first and second single securing members, respectively, and screwing said pair of screw means into said lower portion of the main body so as to secure the main body to said first and second side plates.

2. A keyed instrument comprising:

a main body having a keyboard at a front of said main body;

first and second side plates for supporting said main body, on which said main body is placed and between which at least a lower portion of said main body is arranged;

a back plate arranged between said first and second side plates for reinforcing said first and second side plates;

a first single securing member secured to said main body, said back plate and said first side plate;

a second single securing member secured to said main body, said back plate and said second side plate; and a pair of screw means, each of the screw means extending laterally through one of said first and second side plates and into said lower portion of said main body so as to secure said main body to said first and second side plates.

* * * * *